US005797776A

United States Patent [19]

Kusche

[11] Patent Number: 5,797,776

[45] Date of Patent: Aug. 25, 1998

[54] VIBRATION REDUCTION SYSTEM FOR AN OUTBOARD MOTOR

[75] Inventor: David W. Kusche, Oshkosh, Wis.

[73] Assignee: Brunswick Corporation, Lake Forest, Ill.

[21] Appl. No.: 844,338

[22] Filed: Apr. 18, 1997

[51] Int. Cl.[6] ..... B63H 1/15

[52] U.S. Cl. ..... 440/52; 440/63

[58] Field of Search ..... 440/49, 52, 53, 440/76, 77, 55, 63

[56] References Cited

U.S. PATENT DOCUMENTS 2,488,199 11/1949 Jordan ..... 440/53

2,911,936 11/1959 Kiekhaefer ..... 440/52

*Primary Examiner*—Stephen Avila

*Attorney, Agent, or Firm*—William D. Lanyi

[57] ABSTRACT

The cowl of an outboard motor is provided with resilient pads that are disposed on opposite sides of a steering mechanism with a purpose of reducing vibratory motion of the cowl when an engine is operated at idle speed. The resilient pads are held in place by brackets which are attached to the lower cowl of the outboard motor. The two resilient pads are disposed on opposite sides of the swivel tube head of the steering mechanism.

9 Claims, 4 Drawing Sheets

VIBRATION REDUCTION SYSTEM FOR AN OUTBOARD MOTOR

BACKGROUND OF THE INVENTION

1. Field of the Invention

The present invention relates generally to outboard motors and, more particularly, to a system which reduces the oscillating movement of an outboard motor cowl when the engine is running at idle speed.

2. Description of the Prior Art

In outboard motors that are known to those skilled in the art, the steering mechanism is typically connected to the internal combustion engine through shock absorbing mounts. Through these mounts, which typically incorporate rubber, the steering mechanism is attached to an exhaust adapter which, in turn, is rigidly attached to the internal combustion engine. Connected below the exhaust adapter is a driveshaft housing. Below the driveshaft housing, a gear housing contains the gears necessary to translate the rotation of a vertical driveshaft to a horizontal shaft to which a propeller is attached. The shock absorbing mounts, through which the steering mechanism is connected to the engine, isolate a significant amount of engine vibration from the steering mechanism. It should be understood that the steering mechanism could comprise a handle which is moved directly by a boat operator or, alternatively, a mechanism that allows the motor to be turned by cables controlled by a steering wheel located forward in the boat.

Regardless of the specific type of steering mechanism used, the internal combustion engine of a outboard motor can oscillate about a vertical axis relative to the steering mechanism. This is caused by occasional misfires at idle speed.

Because of the relative movement between the internal combustion engine and the steering mechanism, it can appear that the engine is idling very roughly when at idle speed even though the engine is actually operating properly. This appearance of rough idling is caused by occasional misfires in the cylinders of the internal combustion engine when operated at low speeds and is exaggerated by the relative movement between the cowl surrounding the internal combustion engine and the steering mechanism. This movement is allowed because of the resilient mounts between the steering mechanism and the outboard motor. It would therefore be beneficial if some means were provided to reduce this relative torsional motion between the cowl of the outboard motor and the steering mechanism when the motor is at idle speed.

SUMMARY OF THE INVENTION

An outboard motor made in accordance with the present invention comprises an internal combustion engine mounted for rotation about an axis. A steering device is attached to the engine for the purpose of causing the engine to rotate about the axis. A cowl is disposed around the engine and is attached to the engine. First and second resilient pads are attached to the cowl and disposed at opposite sides of the steering device in order to limit rotational movement of the cowl about the axis relative to the steering device.

In certain applications of the present invention, the cowl is movable relative to the steering mechanism in a direction generally parallel to the axis in response to the movement of the engine relative to a boat to which the outboard motor is attached. In certain applications of the present invention, the first and second resilient pads are made of rubber.

The present invention is particularly useful when the steering device of the outboard motor is mounted to the engine with vibration dampening mounts, which are typically made of rubber.

BRIEF DESCRIPTION OF THE DRAWING

The present invention will be more fully and completely understood from a reading of the description of the preferred embodiment in conjunction with the drawings, in which.

DESCRIPTION OF THE PREFERRED EMBODIMENT

Figure 1:
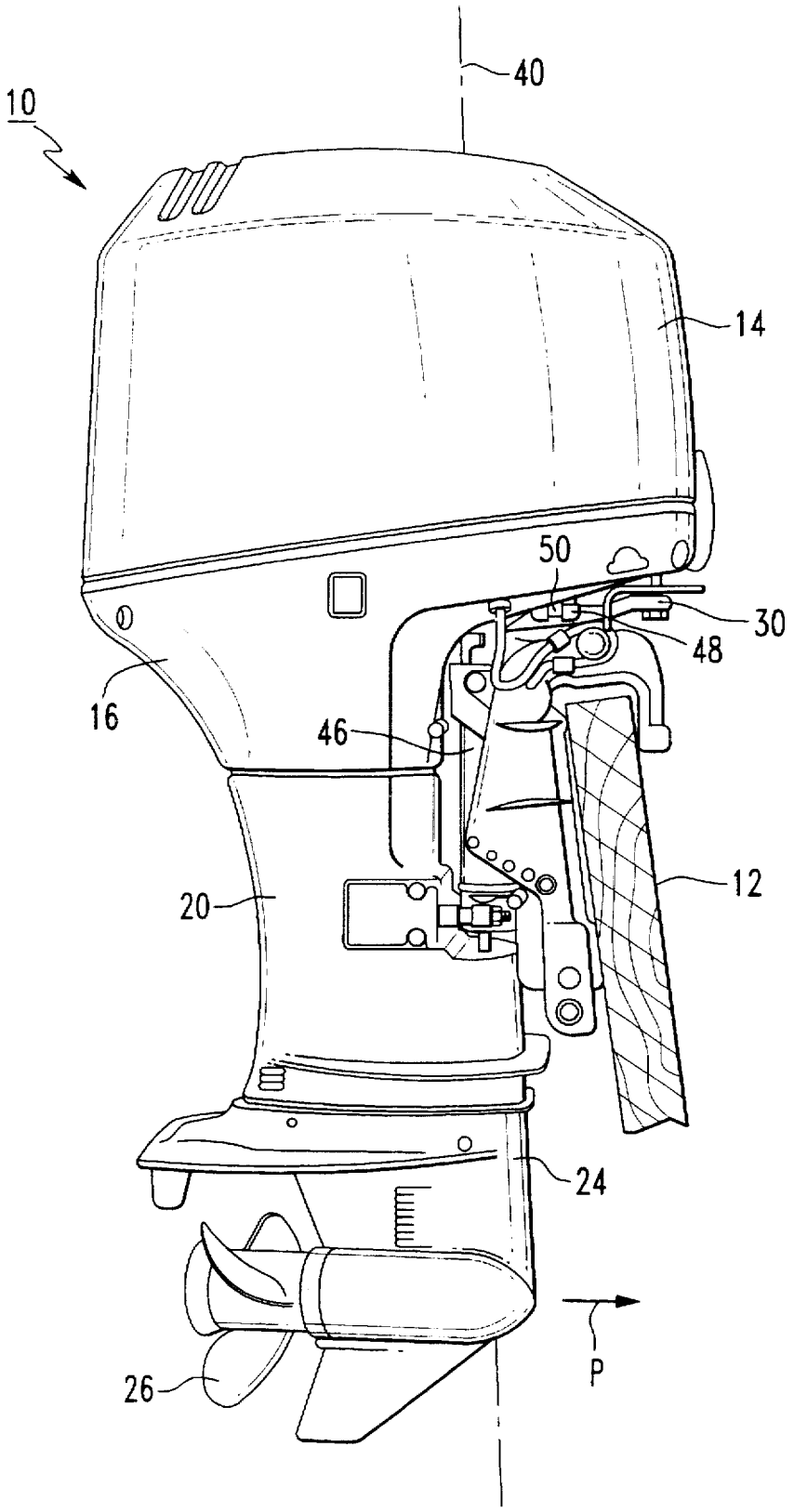
FIG. 1 shows an outboard motor which incorporates the present invention.

Throughout the description of the preferred embodiment, like components will be identified by like reference numerals.

FIG. 1 shows an outboard motor 10 mounted on a transom 12 of a boat (not shown in FIG. 1). The outboard motor 10 comprises an internal combustion engine which is housed inside a compartment defined by an upper cowl 14 and a lower cowl 16. The engine is positioned to drive a vertical driveshaft that extends downward from the internal combustion engine through a driveshaft housing 20 and a gear housing 24. Within the gear housing 24, an arrangement of gears is used to translate the rotation of the vertical axis to a horizontal axis which is attached to a propeller 26. This configuration is generally known to those skilled in the art.

A steering mechanism 30 is connected to the internal combustion engine by shock absorbing mounts which typically comprise a rubber connection. This mounting arrangement reduces the vibration on the steering mechanism 30 that would otherwise be transmitted from the internal combustion engine if the steering mechanism was mounted rigidly to the internal combustion engine. Because of this resilient mount mechanism, the upper 14 and lower 16 cowls can vibrate relative to the steering mechanism 30 sufficiently to cause visible oscillatory motion between the cowls and the steering mechanism. This relative oscillatory motion occurs about axis 40. In FIG. 1, reference numeral 46 indicates the general location of a rotatable tube (not specifically shown in FIG. 1) which is attached to the steering mechanism 30 and allows the motor 10 to be rotated about the axis 40 for steering purposes.

Since outboard motors are typically provided with resilient mounts to isolate the engine from the steering mechanism, the engine is free to move torsionally about axis 40 relative to the steering mechanism 30. At idle speed, when the engine occasionally experiences a misfire, this relative movement between the cowls and the steering mechanism can create the impression of a poor idle when the engine is actually running satisfactorily. In order to minimize the relative movement between the cowls and the steering mechanism, about axis 40, when the engine is at idle speed, two resilient pads are disposed on opposite sides of the steering mechanism 30 and attached to the lower cowl 16. In FIG. 1, reference numeral 48 identifies a bracket which is shaped to hold one of these resilient pads 50.

As described above, this relative movement between the cowls and the steering mechanism is most noticeable when the engine is running at idle speed. When the engine is running at higher speeds, its operation is more smooth and these torsional movements of the engine are significantly reduced.

At higher speeds, the propeller 26 creates a force P which tends to rotate the outboard motor slightly about its mounts. This slight rotation of the outboard motor relative to the transom 12 causes the lower cowl, in the region where the resilient pads are attached, to move upward relative to the steering mechanism 30.

Figure 2:
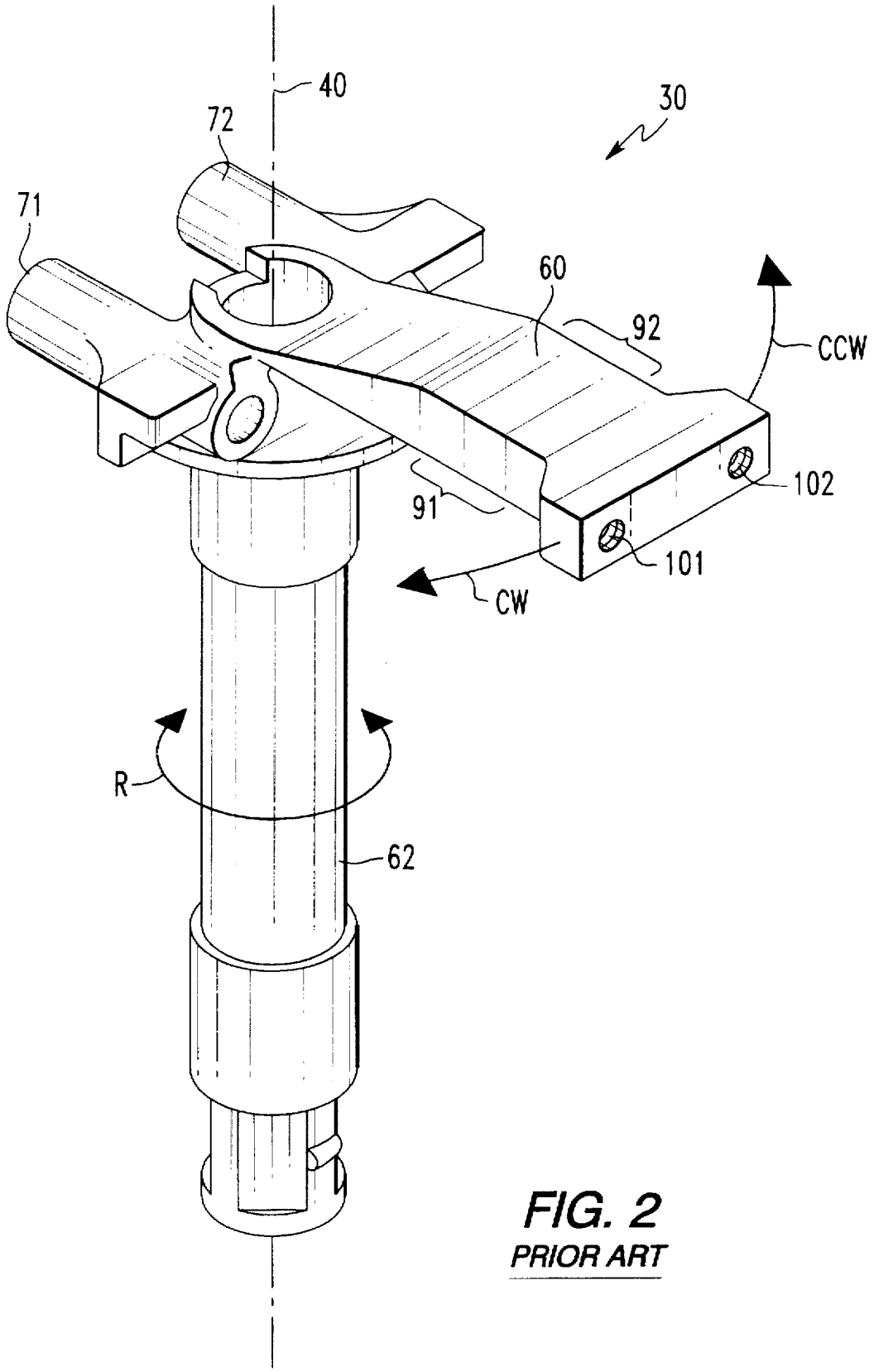
FIG. 2 PRIOR ART
FIG. 2 shows a swivel tube head assembly portion of a steering mechanism for an outboard motor.

FIG. 2 shows a steering mechanism 30. It comprises a swivel tube head 60 which is rigidly attached to a tube 62 disposed about a shaft (not shown) which is coaxial with the axis 40 described above. Reference numerals 71 and 72 identify portions of the steering mechanism 30 which are intended to be attached to the internal combustion engine through resilient shock absorbing mounts.

With continued reference to FIG. 2, the swivel tube head 60 has a first side surface 91 and a second side surface 92 which will be described in greater detail below in conjunction with FIGS. 3 and 4. Holes 101 and 102 provide a means for attaching the swivel tube head 60 to other portions of the steering mechanism which can be a hand operated tiller control or a cable system attached to a steering wheel for operation by the operator of the boat. Regardless of the particular type of steering mechanism provided, the swivel tube head 60 is moved about axis 40 in the directions identified as clockwise CW and counterclockwise CCW in FIG. 2. This movement of the swivel tube head 60 causes rotation of the tube 62 about axis 40 as shown by arrow R. This movement of the steering mechanism 30 allows the internal combustion engine and the propeller 26 to be moved for the purpose of steering.

Figure 3:
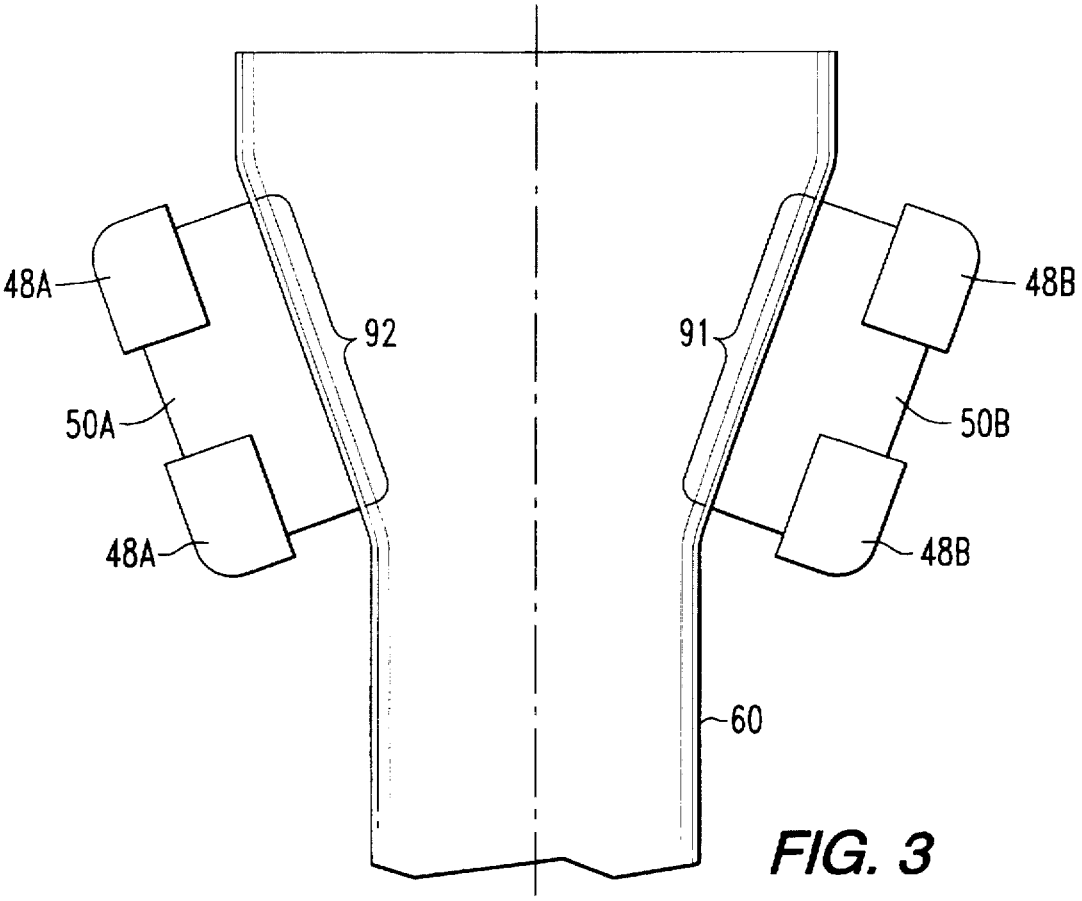
FIG. 3 is a top view of the swivel tube head illustrated in FIG. 2.

FIG. 3 is a section view of the swivel tube head 60. In FIG. 3, the swivel tube head is shown as would be seen from the top portion of FIG. 2 looking down on the steering mechanism 30. The first and second regions, 91 and 92, of the swivel tube head 60 are identified in FIG. 3. Resilient pads, 50A and 50B, are shown supported by bracket systems 48A and 48B. It should be understood that each bracket system comprises two components in the illustrated embodiment which are used in combination to hold the resilient pads 50A and 50B in place. Although not specifically shown in FIG. 3, the bracket systems, 48A and 48B are attached to the lower cowl 16 as shown in FIG. 1.

Figure 4:
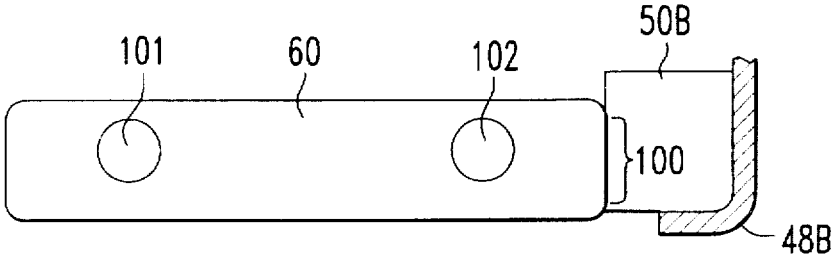
FIG. 4 is an end view of a swivel tube head associated with a resilient pad.

FIG. 4 is an end view of the swivel tube head 60 showing the two holes, 101 and 102, for reference to FIG. 2. Also in FIG. 4, one of the two resilient pads 50B is shown with its bracket 48B.

With reference to FIGS. 2, 3 and 4, it can be seen that the presence of the resilient pads, 50A and 50B, on the sides of the swivel tube head 60 will resist the oscillatory movement of the lower cowl 16 relative to the steering mechanism 30. As the lower cowl 16 begins to move in a torsional direction relative to the steering mechanism 30, the resilient pads, 50A and 50B, will resist that movement and maintain the cowls in a relatively constant position relative to the steering mechanism. The resistance to this movement provided by the resilient pads will result in a reduction of visible oscillations of the cowls about axis 40 relative to the steering mechanism.

With reference to FIG. 4, the overlap between the swivel tube head 60 and the resilient pad 50B is identified by reference numeral 100. When the outboard motor experiences a force P, as described above in conjunction with FIG. 1, the lower cowl 16 will move relative to the steering mechanism 30 and, as a result, will raise the resilient pads, 50A and 50B, upward relative to the swivel tube head 60. This result is illustrated in FIG. 5.

Figure 5:
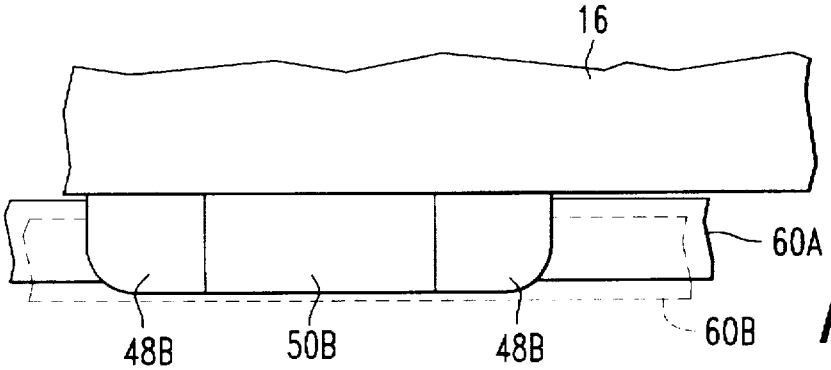
FIG. 5 is a highly schematic illustration of a swivel tube assembly and a resilient pad shown in two relative positions to illustrate movement between the components.

FIG. 5 shows a sectional view of a portion of the lower cowl 16 and one of the brackets 48B which holds resilient pad 50B in place. Also shown in FIG. 5 is the swivel tube head 60 shown in two positions. It should be understood that FIG. 5 is intended to illustrate relative positions between the lower cowl 16 and the swivel tube head 60 and not absolute movement of these components. More specifically, although FIG. 5 shows the swivel tube head 60 in two different positions, it should be understood that these positions of the swivel tube head relative to the lower cowl 60 are actually caused by movement of the lower cowl 16 relative to the swivel tube head 60 which does not generally a vertical position change. For convenience, the relative movement of these components is illustrated in FIG. 5 by showing the movement of the swivel tube head 60 relative to the lower cowl 16.

With continued reference to FIG. 5, the initial position of the swivel tube head 60A is shown in solid line representation. This shows where the swivel tube head would be positioned relative to the lower cowl 16 when the engine is at idle speed. When the engine increases speed, a force P, as shown in FIG. 1 can cause the outboard motor to pivot about its mounts and raise the lower cowl 16 relative to the steering mechanism. This movement creates the change in relative position represented by the swivel tube head 60B illustrated in dashed lines in FIG. 5 to the position of the lower cowl 16 and the resilient pad 50B. As a result, the interface 100, described above in conjunction with FIG. 4, decreases and the effective resistance of the resilient pads, 50A and 50B, is decreased slightly as the engine increases in speed. Although not a required feature in all the embodiments of the present invention, this reduction of overlap 100 can facilitate the operation of the outboard motor by reducing the resistance to the motion of the cowls when the engine is being operated at an increased speed above idle.

Figure 6:
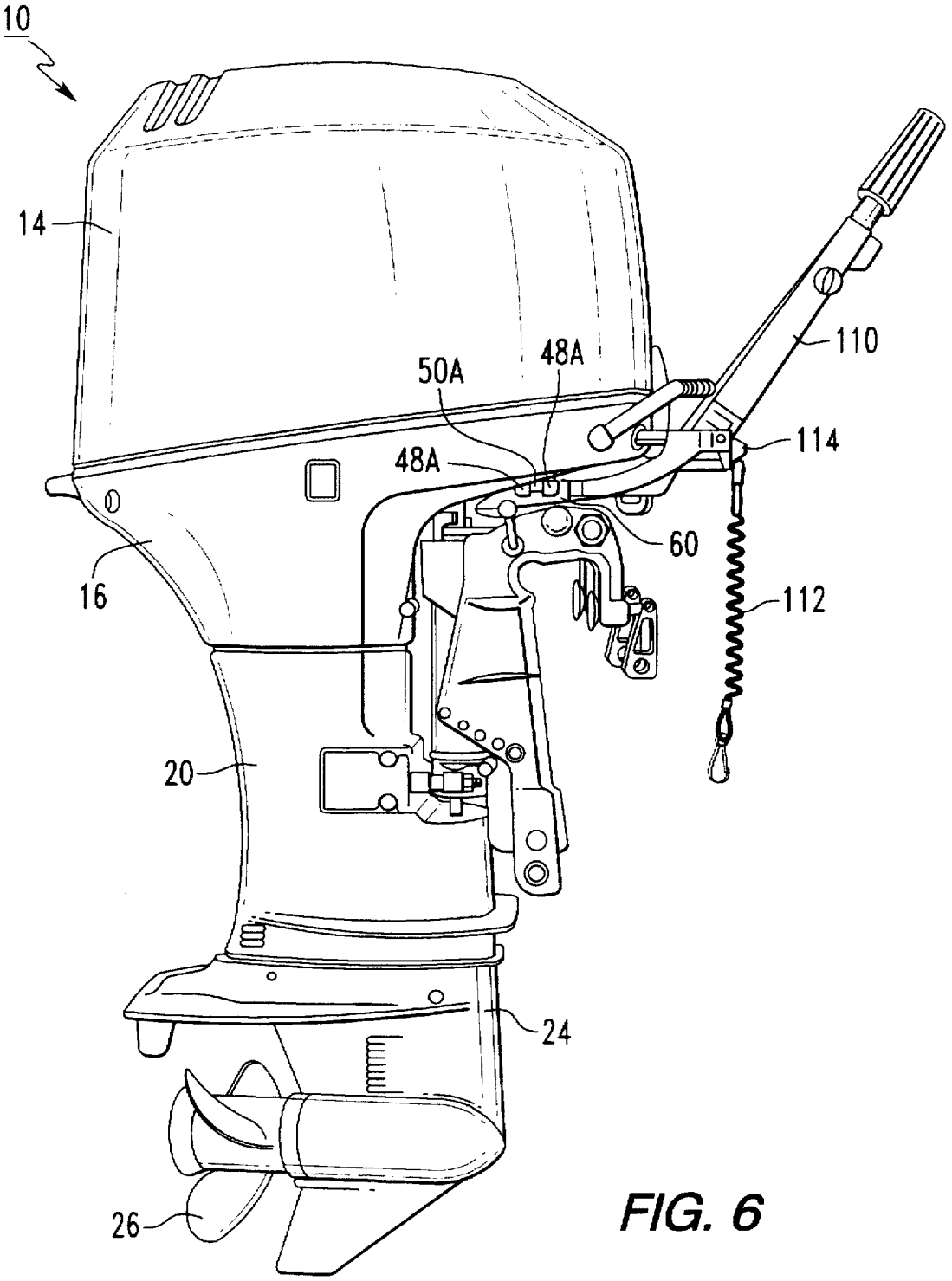
FIG. 6 shows the association of the present invention in conjunction with a steering mechanism which is different than the steering mechanism used in FIG. 1.

FIG. 6 shows an outboard motor 10 which is similar to that shown in FIG. 1, but with an alternative steering mechanism. FIGS. 1 and 6 illustrate that the present invention can be used on outboard motors, regardless of the specific configuration of the steering mechanism used. In FIG. 6, a tiller 110 is connected to the swivel tube head 60 for use as a steering mechanism. Since the swivel tube head 60 is attached to the engine through rubber mounts, the tiller 110 is significantly isolated from the engine vibrations. When running at idle speeds, the cowls could vibrate with sufficient magnitude to create the visual impression of improper operation, but the resilient pads 50 reduce this torsional movement by limiting the motion of the cowls relative to the steering mechanism. In FIG. 6, a lanyard 112 is also illustrated connected to a stop switch 114. These components are typically provided when a tiller 110 is used, as opposed to the configuration in FIG. 1 where the engine is controlled through a cable system attached to a steering wheel in the forward portion of a boat.

By dampening the torsional movement of the cowls relative to the steering mechanism, the present invention provides a means for reducing the vibration of the engine, particularly the visible movement resulting from that vibration. Although a very specific embodiment of the present invention has been described and illustrated, it should be understood that alternative configurations can also be used.

I claim:

1. An outboard motor, comprising:

an internal combustion engine mounted for rotation about an axis;

a steering device attached to said engine for causing said engine to rotate about said axis;

a cowl disposed around said engine, said cowl being attached to said engine; and first and second resilient pads attached to move in coordination with said cowl and disposed at opposite sides of said steering device to limit rotational movement of said cowl about said axis relative to said steering device, said first and second resilient pads being positioned relative to said steering device to define an overlap area between said steering device and each of said resilient pads, the magnitude of said overlap area being inversely proportional to the speed of said engine.

2. The outboard motor of claim 1, wherein:

said cowl is movable relative to said steering mechanism in a direction generally parallel to said axis in response to movement of said engine relative to a boat to which said outboard motor is attached.

3. The outboard motor of claim 1, wherein:

said first and second resilient pads are rubber.

4. The outboard motor of claim 1, wherein:

said steering device is mounted to said engine with vibration dampening mounts.

5. An outboard motor, comprising:

an internal combustion engine mounted for rotation about an axis;

a steering device attached to said engine for causing said engine to rotate about said axis;

a cowl disposed around said engine, said cowl being attached to said engine, said cowl being movable relative to said steering mechanism in a direction generally parallel to said axis in response to movement of said engine relative to a boat to which said outboard motor is attached; and first and second resilient pads attached to move in coordination with said cowl and disposed at opposite sides of said steering device to limit rotational movement of said cowl about said axis relative to said steering device, said first and second resilient pads being positioned relative to said steering device to define an overlap area between said steering device and each of said resilient pads, the magnitude of said overlap area being inversely proportional to the speed of said engine.

6. The outboard motor of claim 5, wherein: said first and second resilient pads are rubber.

7. The outboard motor of claim 6, wherein:

said steering device is mounted to said engine with vibration dampening mounts.

8. An outboard motor, comprising:

an internal combustion engine mounted for rotation about an axis;

a steering device attached to said engine for causing said engine to rotate about said axis;

a cowl disposed around said engine, said cowl being attached to said engine, said cowl being movable relative to said steering mechanism in a direction generally parallel to said axis in response to movement of said engine relative to a boat to which said outboard motor is attached; and first and second resilient pads attached to move in coordination with said cowl and disposed at opposite sides of said steering device to limit rotational movement of said cowl about said axis relative to said steering device, said first and second resilient pads being rubber, said first and second resilient pads being positioned relative to said steering device to define an overlap area between said steering device and each of said resilient pads, the magnitude of said overlap area being inversely proportional to the speed of said engine.

9. The outboard motor of claim 8, wherein:

said steering device is mounted to said engine with vibration dampening mounts.

* * * * *